US010460884B2

(12) United States Patent
Pankofer et al.

(10) Patent No.: US 10,460,884 B2
(45) Date of Patent: Oct. 29, 2019

(54) SWITCHING ARRANGEMENT FOR A CONTROL TRANSFORMER, IN PARTICULAR POLARITY SWITCHING MEANS

(71) Applicant: Maschinenfabrik Reinhausen GmbH, Regensburg (DE)

(72) Inventors: Martin Pankofer, Plattling (DE); Moritz Bengler, Regensburg (DE); Eduard Zerr, Regensburg (DE); Gerhard Baeuml, Regenstauf (DE); Wladimir Bauer, Regensburg (DE); Sebastian Rehkopf, Regensburg (DE); Stefan Herold, Regensburg (DE); Benedikt Ittlinger, Regensburg (DE); Andreas Stocker, Neutraublingen (DE); Markus Zintl, Mitterteich (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 79 days.

(21) Appl. No.: 15/329,901

(22) PCT Filed: Aug. 21, 2015

(86) PCT No.: PCT/EP2015/069241

§ 371 (c)(1),
(2) Date: Jan. 27, 2017

(87) PCT Pub. No.: WO2016/034439

PCT Pub. Date: Mar. 10, 2016

(65) Prior Publication Data

US 2017/0271098 A1 Sep. 21, 2017

(30) Foreign Application Priority Data

Sep. 4, 2014 (DE) ..... 10 2014 112 764

(51) Int. Cl.
*H01H 9/00* (2006.01)
*H01F 29/04* (2006.01)
(Continued)

(52) U.S. Cl.
CPC ..... *H01H 9/0038* (2013.01); *H01F 29/025* (2013.01); *H01F 29/04* (2013.01);
(Continued)

(58) Field of Classification Search
CPC .. H01H 9/0038; H01H 9/0016; H01H 9/0027; H01H 9/52; H01H 9/0044; H01H 2205/002; H01F 29/025; H01F 29/04
See application file for complete search history.

(56) References Cited

U.S. PATENT DOCUMENTS 8,576,038 B2 11/2013 Kraemer
2015/0061806 A1* 3/2015 Teising ..... H01H 9/0027 336/150
2016/0211090 A1 7/2016 Kaltenborn

FOREIGN PATENT DOCUMENTS

DE 19821775 B 10/1999
DE 19821775 C1 * 10/1999 ..... H01H 9/0038
EP 2261935 A 12/2010

* cited by examiner

*Primary Examiner* — Jue Zhang
(74) *Attorney, Agent, or Firm* — Andrew Wilford

(57) ABSTRACT

A switching arrangement (1), in particular a polarity switching means, for a control transformer (10) which comprises a first winding (2) for a phase of an AC power supply system, which phase is to be controlled, comprises —a first connection terminal (1.1) which can be connected to the winding (2); —a second connection terminal (1.2) which can be connected to a discharge line (3); —a vacuum interrupter (4); —an isolator (5); —a resistor (6) which is connected in series with the vacuum interrupter (4) and the isolator (5); wherein —the first connection terminal (1.1) is
(Continued)

connected to the second connection terminal (1.2) by means of the series circuit.

9 Claims, 11 Drawing Sheets

(51) Int. Cl.
*H01F 29/02* (2006.01)
*H01H 9/52* (2006.01)

(52) U.S. Cl.
CPC ..... *H01H 9/0016* (2013.01); *H01H 9/0027* (2013.01); *H01H 9/52* (2013.01); *H01H 9/0044* (2013.01); *H01H 2205/002* (2013.01)

SWITCHING ARRANGEMENT FOR A CONTROL TRANSFORMER, IN PARTICULAR POLARITY SWITCHING MEANS

CROSS REFERENCE TO RELATED APPLICATIONS

This application is the US-national stage of PCT application PCT/EP2015/069241 filed 21 Aug. 2015 and claiming the priority of German patent application 102014112764.1 itself filed 4 Sep. 2014.

FIELD OF THE INVENTION

The present invention relates to a switch assembly for a control transformer, particularly a polarity switch.

BACKGROUND OF THE INVENTION

A tap changer with a preselector and a polarity switch, with the help of which formation of gas in the insulating oil is to be reduced, is known from DE 10 2009 060 132 [U.S. Pat. No. 8,576,038]. The tap changer comprises a selector and a load changeover switch. The selector prior to a switching process initially makes power-free preselection of the new winding tap of the tapped winding to be switched over to. The switching itself is carried out by the load changeover switch. A first polarity resistor connected by a first polarity switch with a load diverter, is attached to one end of the tap winding. A second polarity resistor, which in turn is connected with the load diverter by a second polarity switch, is attached to the opposite end of the tap winding. The two polarity switches are switched on only briefly before the start of actuation of the preselector, so that the ends of the tap winding are coupled to a defined electrical potential only briefly. A disadvantage of this solution is that switching-on and switching-off of the polarity resistors can generate an arc which may cause breakdown of the insulating oil in the tap changer. Undesired chemical products can thereby arise, such as, for example, soot and gases that contaminate the insulating oil and thus shorten the service life of the tap changer or the control transformer, also termed tapped transformer.

OBJECT OF THE INVENTION

It is an object of the invention to provide a switch assembly for a control transformer that arrangement enables disruption-free and gas-free operation of a control transformer.

SUMMARY OF THE INVENTION

In the following, a formulation like 'A is connected with B' encompasses the meanings 'A is directly electrically conductively connected with B' and 'A is indirectly, thus via C, electrically conductively connected with B' and a formulation of the kind 'A is attached to B' has the meaning 'A is directly electrically conductively connected with B'.

The invention proposes a circuit arrangement for a control transformer which comprises a first winding for a phase to be regulated, of an alternating current mains, comprising:

- a first connection terminal which can be connected with the winding;
- a second connection terminal which can be connected with a shunt;

- a vacuum interrupter;
- an isolator; and
- a resistor connected in series with the vacuum interrupter and the isolator;

wherein

- the first connection terminal is connected with the second connection terminal by the series circuit.

Through use of the vacuum interrupter, the proposed switch assembly produces or avoids breakdown of and formation of gas in the insulating oil during switching-on and switching-off of the resistor.

The proposed switch assembly can be constructed in any desired mode and manner according to requirements and can comprise, for example, at least one or no additional connection terminal and/or at least one or no additional vacuum interrupter and/or at least one or no additional isolator and/or at least one or no additional resistor.

The connection of the first connection terminal with the winding can preferably be carried out in such a way that the first connection terminal is connected with an intermediate tap of the winding, the intermediate tap lying between the two winding ends of the winding.

The isolator can be constructed in any desired mode and manner according to requirements, for example in such a way that it or at least the contacts thereof is or are present in a dielectric medium or air or SF6 or insulating oil and/or, for example, it does not include any vacuum interrupters or semiconductor switches.

It can be provided that

- the isolator comprises at least one stationary switching-on contact and at least one electrically conductive movable bearing housing that can be selectably connected with the switching-on contact or separated from the switching-on contact.

The switching-on contact is preferably fixedly mounted on a frame. The bearing housing preferably has at its outer side at least one resiliently mounted contact which in the closed state of the isolator produces an electrically conductive connection between the switching-on contact and bearing housing.

It can be provided that the switch assembly comprises

- a rotatably mounted polarity rotor actuated, in particular opens or closes, by rotating the isolator and the vacuum interrupter and on which, in particular, the bearing housing is mounted.

It can be provided that

- the polarity rotor has an upper support plate and lower support plate, between which the vacuum interrupter is mounted to be vertical;
- the vacuum interrupter has a fixed contact and a movable contact;
- the fixed contact is arranged at the lower support plate and the movable contact is mechanically connected with the upper support plate; and
- a drive shaft by which the polarity rotor can be rotated is arranged vertically between the support plates.

It can be provided that

- the movable contact is mechanically connected with an actuating lever;
- the actuating lever is pivotably mounted by a first end in the bearing housing; and
- the actuating lever carries a roller at a second end.

It can be provided that the switch assembly comprises

- a cam cylinder in which the polarity rotor is rotatable;

wherein

- the cam cylinder has at an upper edge a contour with at least one contour section; and the roller during rotation of the polarity rotor travels along at least one contour section and thus the vacuum interrupter is actuated, in particular opened or closed.

It can be provided that the switch assembly for the control transformer—which for at least one additional phase to be regulated, of the alternating current mains comprises at least one additional first winding—is constructed and comprises for each additional winding an additional first connection terminal connectable with the additional winding, an additional second connection terminal connectable with a diverter, an additional vacuum interrupter, an additional isolator and an additional resistor connected in series with the additional vacuum interrupter and the additional isolator;

and actuating means for actuating the vacuum interrupters in a predetermined sequence;

wherein each additional first connection terminal is connected with the respective second connection terminal by the respective series circuit.

It can be provided that the actuating means is so constructed that at least two vacuum interrupters are actuated, in particular opened or closed, with an offset in time relative to one another.

It can be provided that the actuating means comprises the cam cylinder; and at least one contour section is assigned to each vacuum interrupter.

It can be provided that the cam sections are so constructed that when the polarity rotor is rotated at least two vacuum interrupters are actuated, in particular opened or closed, with an offset in time relative to one another.

It can be provided that the switch assembly for the control transformer comprising a second winding for at least one phase to be regulated, wherein the first winding associated with this phase has a first winding tap and second winding tap and an intermediate tap between the winding taps, is constructed and comprises a preselector, comprising a first preselector terminal connectable with the first winding tap;

a second preselector terminal connectable with the second winding tap;

a base terminal connectable with the second winding; and a preselector contact connected with the base terminal and selectably connectable with the first or second preselector terminal;

wherein the first connection terminal can be connected with the first winding by connection with the intermediate tap.

It can be provided that the preselector is constructed as a reverser or coarse selector.

If the preselector is constructed as a reverser then by example the second winding is constructed as main winding and the first winding as control winding. A reverser makes it possible to connect the control winding with the main winding selectably in the same sense or in opposite sense with respect to the main winding.

If the preselector is constructed as a coarse selector then, by example, the second winding is constructed as control winding and the first winding as main winding and, for example, the first winding tap is at the first winding end of the first winding and the second winding tap is between the winding ends of the first winding or, for example, the second winding tap is at the second winding end of the first winding and the first winding tap is between the winding ends or, for example, the two winding taps are between the winding ends. The part between the winding taps is usually termed coarse step winding or coarse step. A coarse selector makes it possible to selectably connect or not connect the coarse step winding with the control winding, thus to bridge over the coarse step winding.

BRIEF DESCRIPTION OF THE DRAWING

In the following, embodiments of the invention are explained in more detail by example with reference to the accompanying drawings. However, the individual features evident therefrom are not restricted to the individual embodiments, but can be connected and/or combined with further above-described individual features and/or with individual features of other embodiments. The details in the drawings are to be understood as merely explanatory and not restrictive. The reference numerals present in the claims are not to restrict the scope of protection of the invention in any way, but refer merely to the embodiments shown in the drawings.

In the drawings.

SPECIFIC DESCRIPTION OF THE INVENTION

Figure 1:
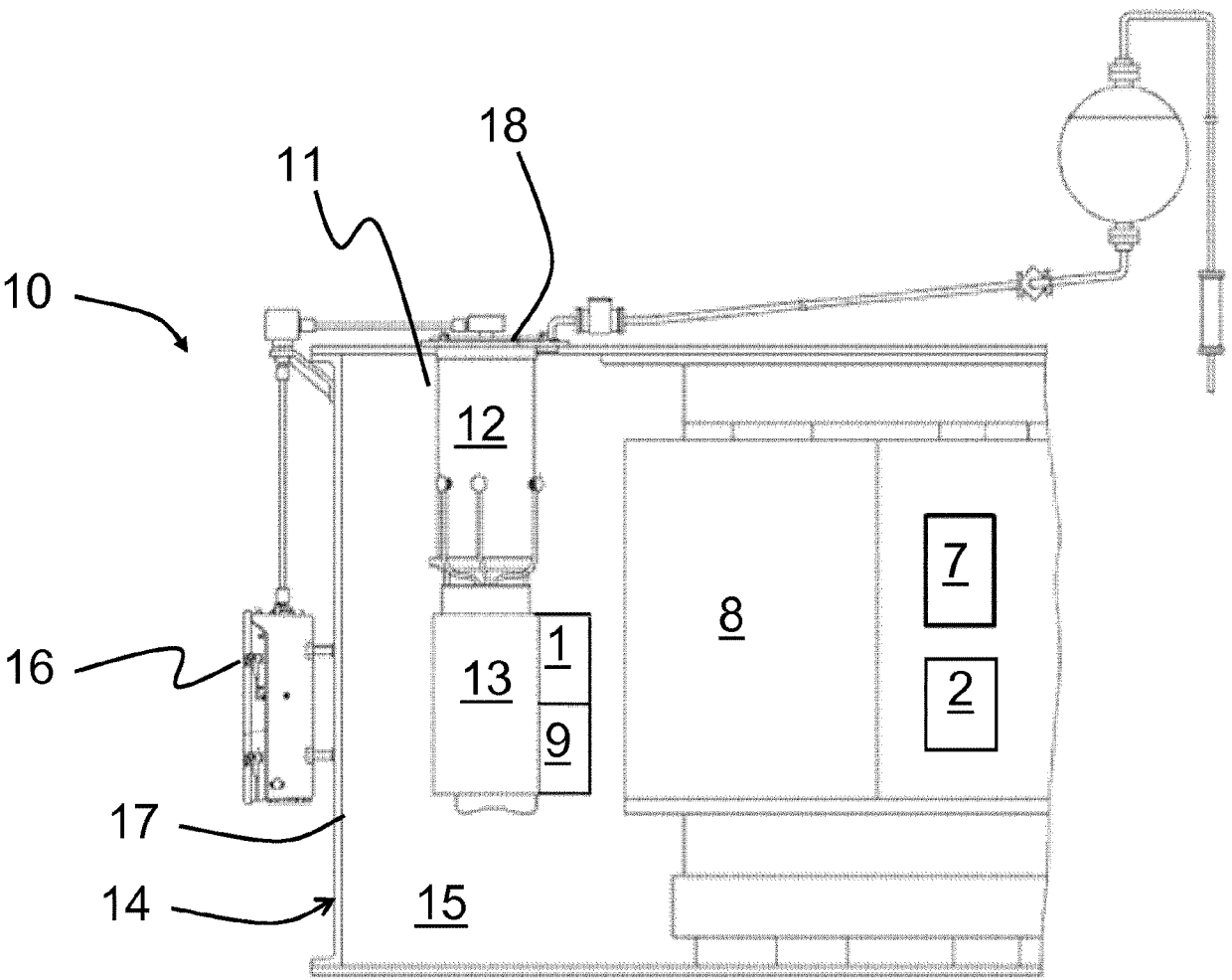
FIG. 1 shows a control transformer with an on-load tap changer comprising a load changeover switch, a preselector and a switch assembly according to the invention.

An embodiment of a control transformer 10 comprising an upper-voltage or primary side with two windings 2, 7, a lower-voltage or secondary side 8 and an on-load tap changer 11, is illustrated in FIG. 1. The on-load tap changer 11 comprises a load changeover switch 12, a selector with a preselector 9 and a fine selector 13 and a switch assembly 1 according to the invention. The control transformer 10 is surrounded by a transformer housing 14. The different winding taps 2.1 (see FIG. 2) of the control transformer 10 can be connected by the on-load tap changer 11 arranged in the interior 15 of the transformer housing 14. In order to be able to ensure correct functioning of the control transformer 10 the on-load tap changer 11 has to execute the required switching sequence without disruptions. The on-load tap changer 11 projects into the transformer housing 14 that, depending on the type of control transformer 10, can be filled with insulating oil. The on-load tap changer 11 here comprises, by example, a load changeover switch 12 and preselector 9, but can also be constructed as a load selector.

The on-load tap changer 11 is actuated by means of a motor drive 16 fastened to an outer wall 17 of the transformer housing 14, by a linkage. However, the motor drive 16 can also be directly arranged on the cover 18 of the on-load tap changer 11, thus on the head of the on-load tap changer 11.

The control transformer 10 comprises, for each phase to be regulated of an alternating mains current (not illustrated), a first winding 2 and a second winding 7 usually on the primary side. The switch assembly 1 can, for example, as a polarity circuit at times electrically connect the first winding 2 with a diverter during switching of the preselector 9 attached to the first winding 2 and the second winding 7, as described in detail in the following with reference to FIG. 2.

In this embodiment the preselector 9 is constructed separately from the switch assembly 1, but it can also be integrated in the switch assembly 1 or combined with the switch assembly 1.

Figure 2B:
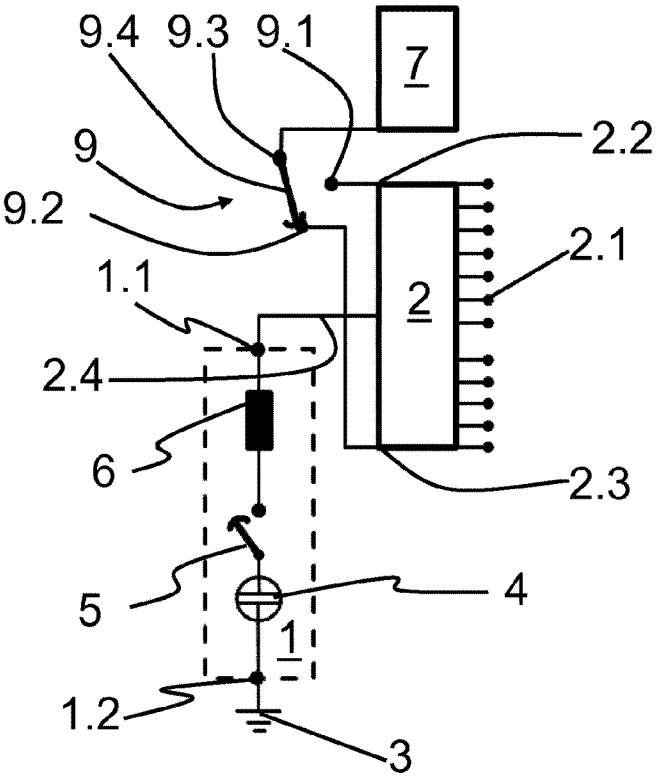
FIGS. 2*a-h* are circuit diagrams of a first embodiment of the switch assembly as well as a switching sequence of the switch assembly.
Figure 2A:
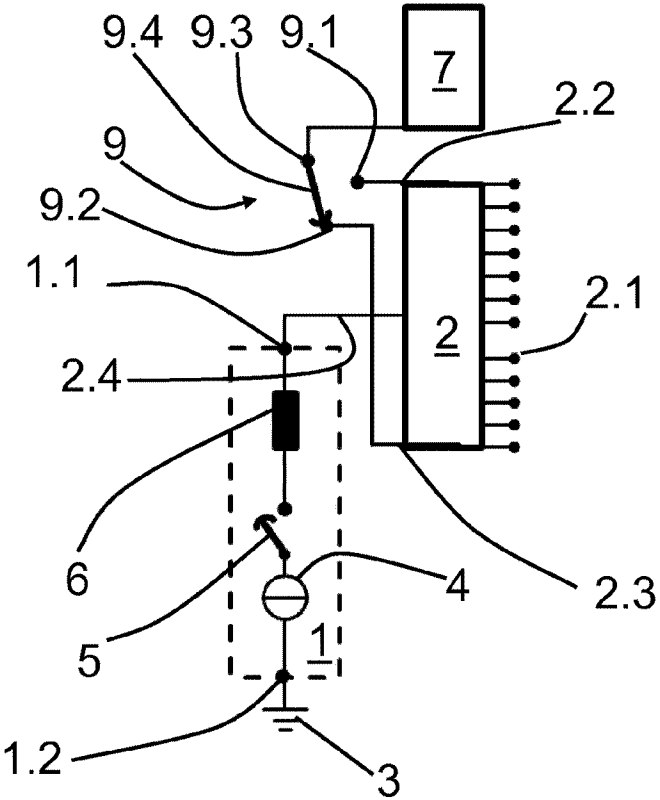

A circuit diagram of a first embodiment of the switch assembly 1 for a control transformer 10 is schematically illustrated in FIG. 2*a*.

In this embodiment the first winding 2 is constructed as a control winding, the second winding 7 as a main winding associated with the control winding, and the preselector 9 as a reverser for the control winding 2, but the first winding 2 can also be constructed as a coarse step winding, the second winding 7 as a control winding associated with the coarse step winding, and the preselector 9 as a coarse selector for the coarse step winding. The control winding 2 has tapping points 2.1, two winding taps 2.2, 2.3 that, for example, lie at the winding ends of the control winding 2 and/or form these winding ends, and—between these winding taps 2.2, 2.3—an intermediate tap 2.4 which, for example, lies in the center of the control winding 2.

The switch assembly 1 comprises two connection terminals 1.1, 1.2, a vacuum interrupter 4, an isolator 5 and a resistor 6. The first connection terminal 1.1 is electrically conductively connected with the intermediate tap 2.4 and the second connection terminal 1.2 is electrically conductively connected with a diverter 3. The diverter 3 is, for example, coupled to ground potential, but it can also be electrically conductively connected directly or indirectly by a diverter rail with another defined electrical potential which can be, for example, a star point, ground or a triangle point of a transformer.

The vacuum interrupter 4, isolator 5 and resistor 6 are connected in series between the first connection terminal 1.1 and the second connection terminal 1.2 so that the connection terminals 1.1, 1.2 are electrically conductively connected together by the series circuit.

In the static state illustrated in FIG. 2*a*, of the switch assembly 1 the isolator 5 is open and the vacuum interrupter 4 closed. It is thereby achieved that the bearing housing 24 (FIG. 3) of the isolator 5 and the vacuum interrupter 4 lie at the same defined potential, whereas the switching-on contact 32 (FIG. 5) of the isolator 5 and the resistor 6 lie at a different potential.

The control winding 2 can be connected with the main winding 7, for example, by the preselector 9 selectably in the same sense or in opposite sense. The preselector 9 thus forms a reverser and has two preselector terminals 9.1, 9.2, a base terminal 9.3 and a movable preselector contact 9.4 connected with the base terminal 9.3 and can be selectably brought into electrical contact with each preselector terminal 9.1, 9.2. The first preselector terminal 9.1 is attached to the first winding tap 2.2, the second preselector terminal 9.2 to the second winding tap 2.3 and the base terminal 9.3 to the main winding 7.

The switching sequence of the switch assembly 1 is depicted in FIGS. 2*b* to 2*h* starting from the static state of FIG. 2*a*.

FIG. 2*b* shows the first step, in which the vacuum interrupter 4 is opened.

Figure 2D:
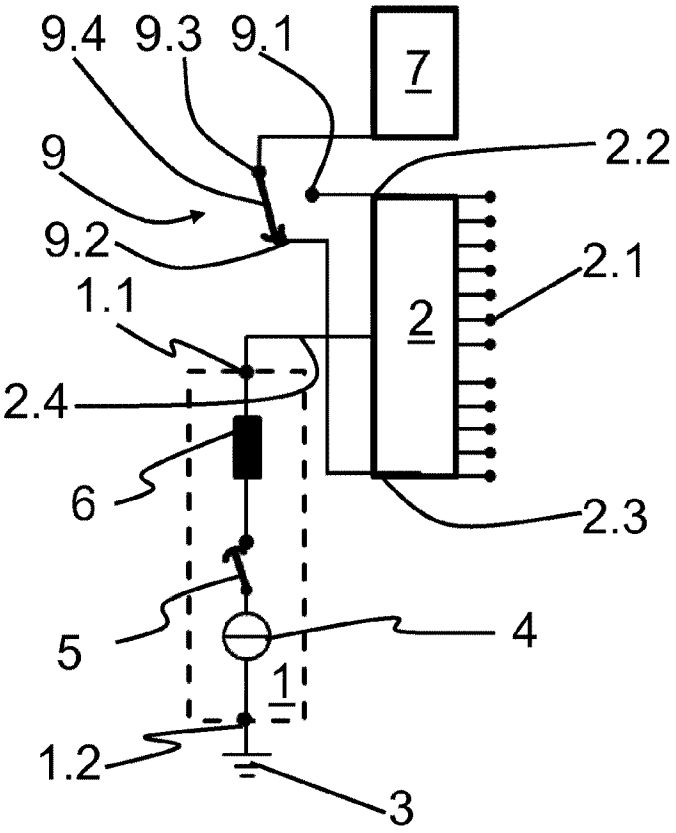
Figure 2C:
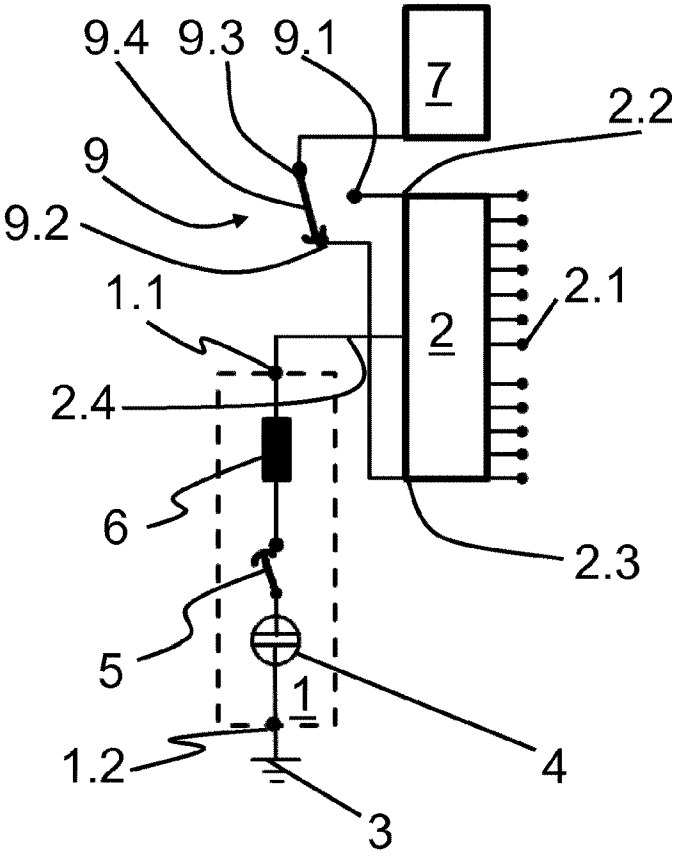

FIG. 2*c* shows the second step in which the isolator 5 is closed.

FIG. 2*d* shows the third step, in which the vacuum interrupter 4 is closed. The resistor 6 is now electrically conductively connected with the diverter 3.

Figure 2F:
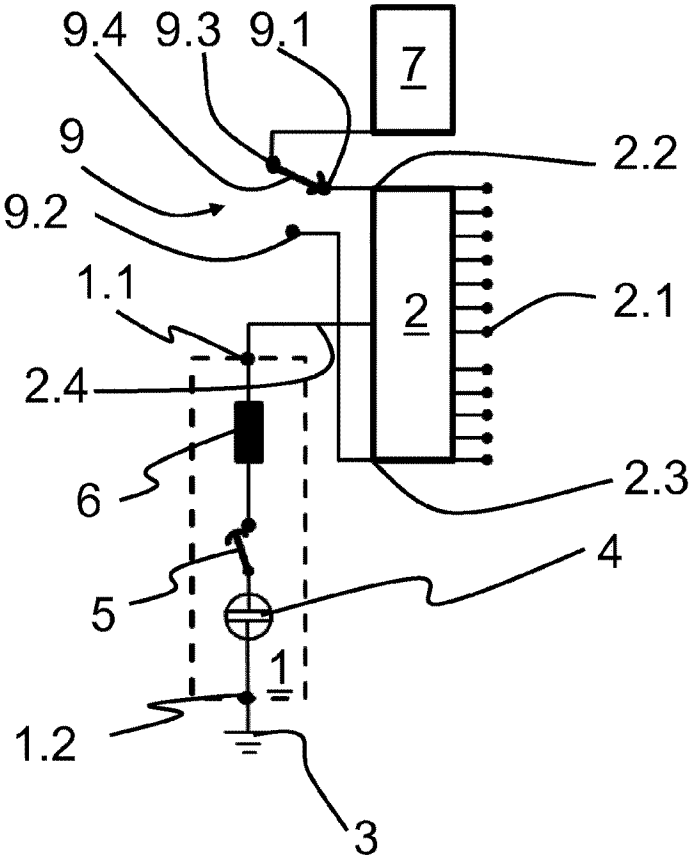
Figure 2E:
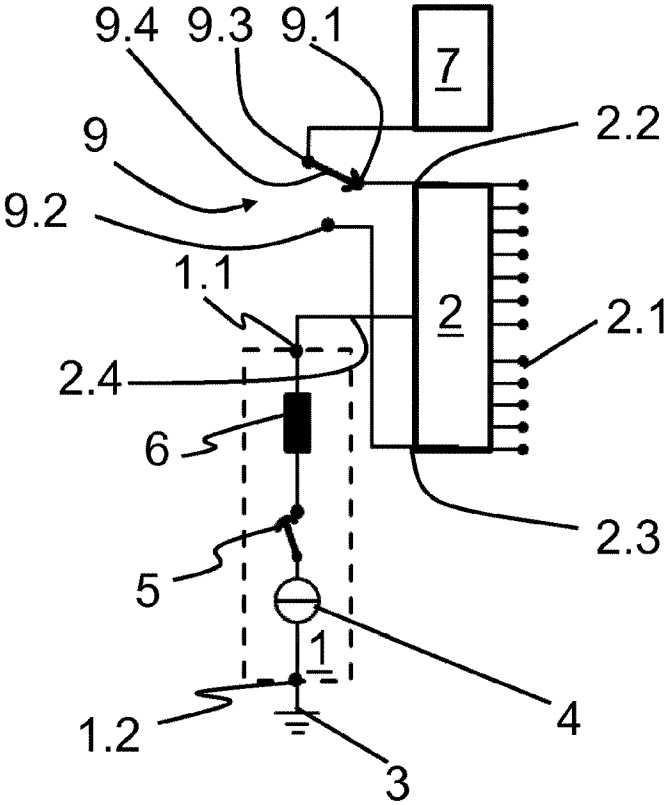

FIG. 2*e* shows the fourth step, in which the preselector 9 is switched over and for that purpose separates the preselector contact from the second preselector terminal 9.2 and is connected with the first preselector terminal 9.1. During this, the center of the control winding 2 is at ground potential by the switch assembly 1.

FIG. 2*f* shows the fifth step, in which the vacuum interrupter 4 is opened.

Figure 2H:
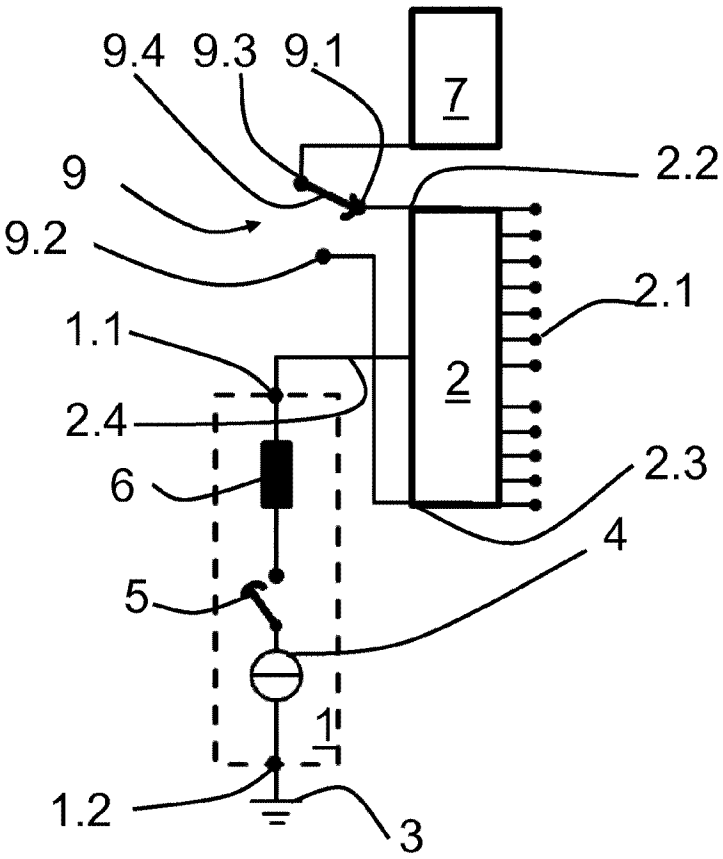
Figure 2G:
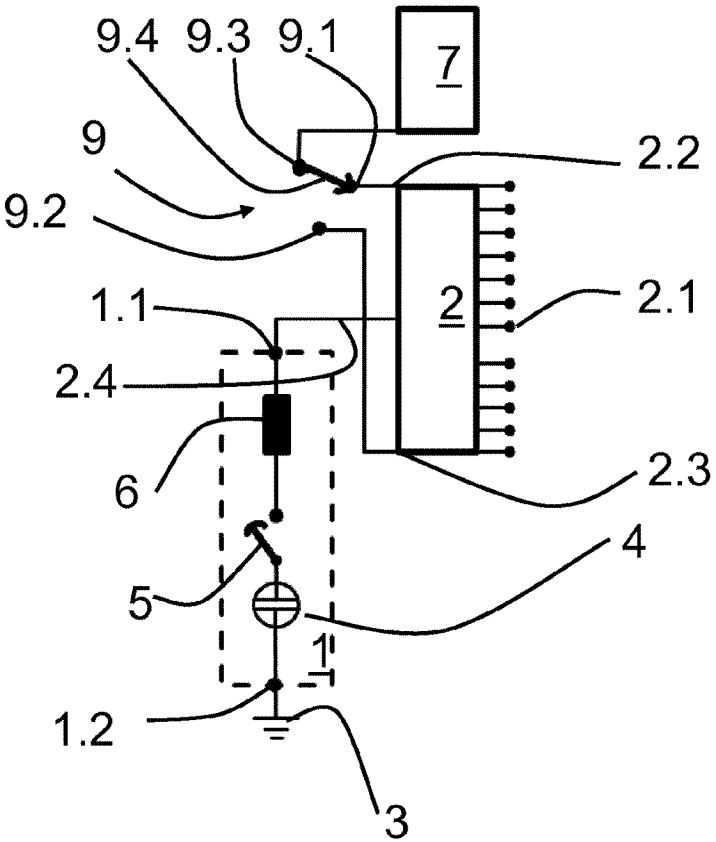

FIG. 2*g* shows the sixth step, in which the isolator 5 is opened.

FIG. 2*h* shows the seventh step, in which the vacuum interrupter 4 is closed. The switch assembly 1 has now again reached a static state in which the isolator 5 is open and the vacuum interrupter 4 closed.

The switching sequence can thus be divided into two phases. Switching-on of the resistor 6 takes place in the first phase and switching-off of the resistor 6 takes place in the second phase. Actuation of the preselector 9 usually takes place between these phases.

A preferred embodiment of the switch assembly 1 of FIGS. 2*a-h* as a constructional configuration for three phases is schematically illustrated in FIGS. 3 to 7.

Figure 3:
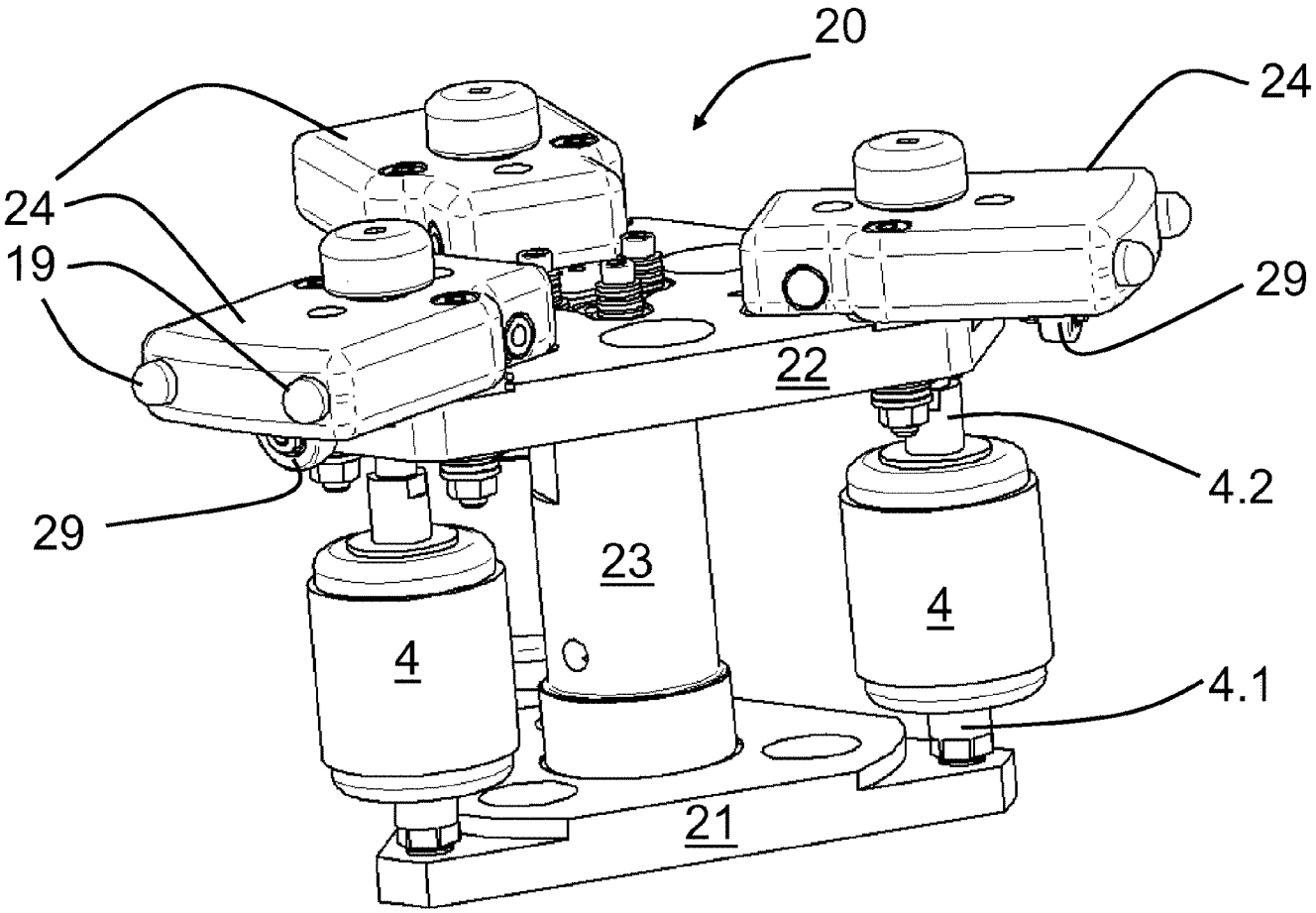
FIG. 3 is a perspective view of a polarity rotor for the switch assembly of FIG. 7.

In this embodiment the switch assembly 1 comprises a rotatably mounted polarity rotor 20 shown in FIG. 3. The polarity rotor 20 comprises a lower support plate 21 and an upper support plate 22, between which a drive shaft 23 is arranged. The drive shaft 23 is mechanically connected with the support plates 21, 22 in such a way that when rotation of the drive shaft 23 takes place the support plates 21, 22 are also rotated. The support plates 21, 22 have, for example, the plan shape of an equilateral triangle, wherein a respective vacuum interrupter 4 is mounted at each corner between the support plates 21, 22 so to be oriented in vertical direction. Each vacuum interrupter 4 has a fixed contact 4.1 and a movable contact 4.2, wherein the fixed contact 4.1 is fastened to, for example, the lower support plate 21. Each movable contact 4.2 extends through the upper support plate 22 and is mechanically and electrically conductively connected with a bearing housing 24.

Figure 4:
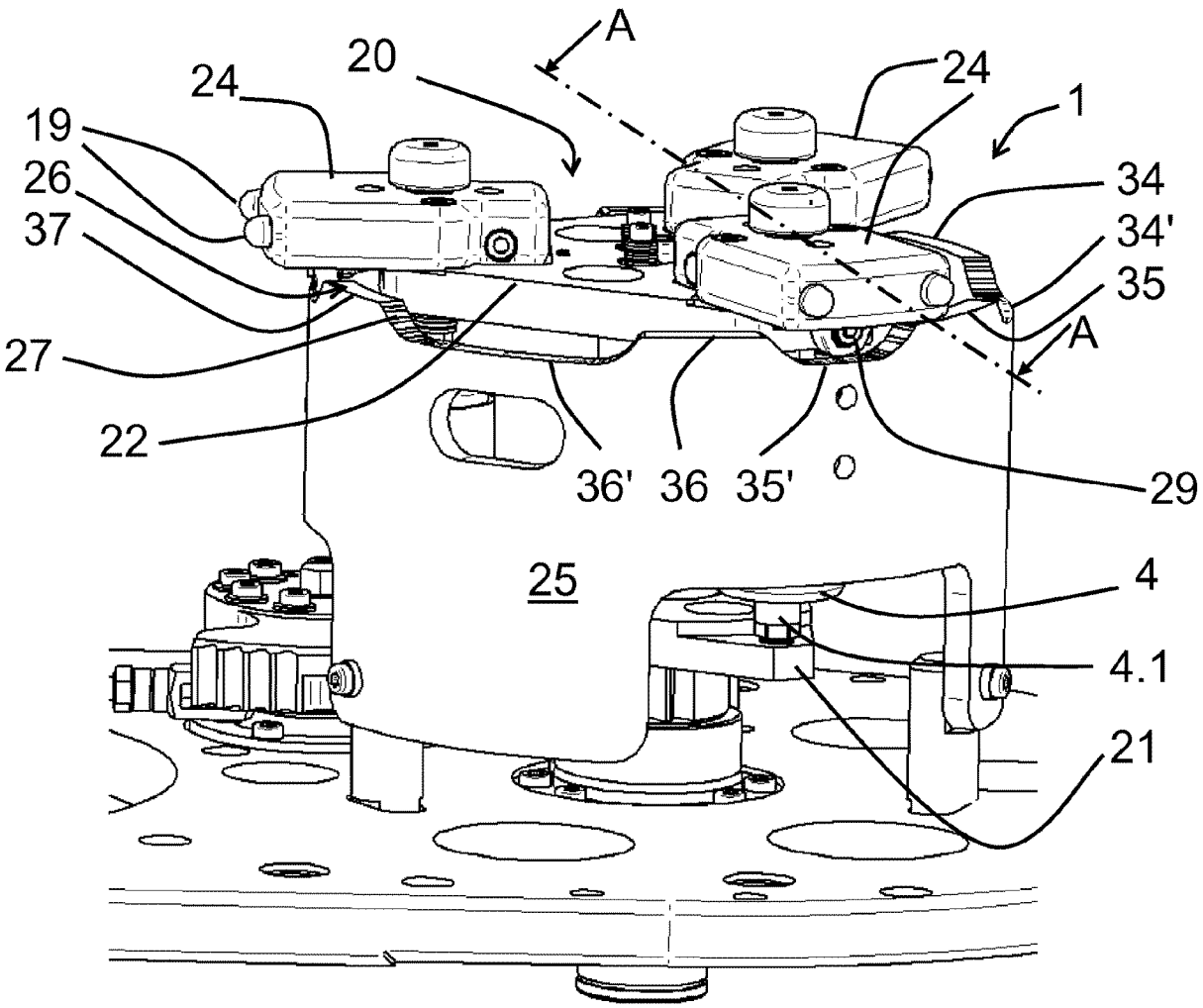
FIG. 4 is a perspective view of a cam cylinder for the switch assembly of FIG. 7 with the polarity rotor of FIG. 3.
Figure 5:
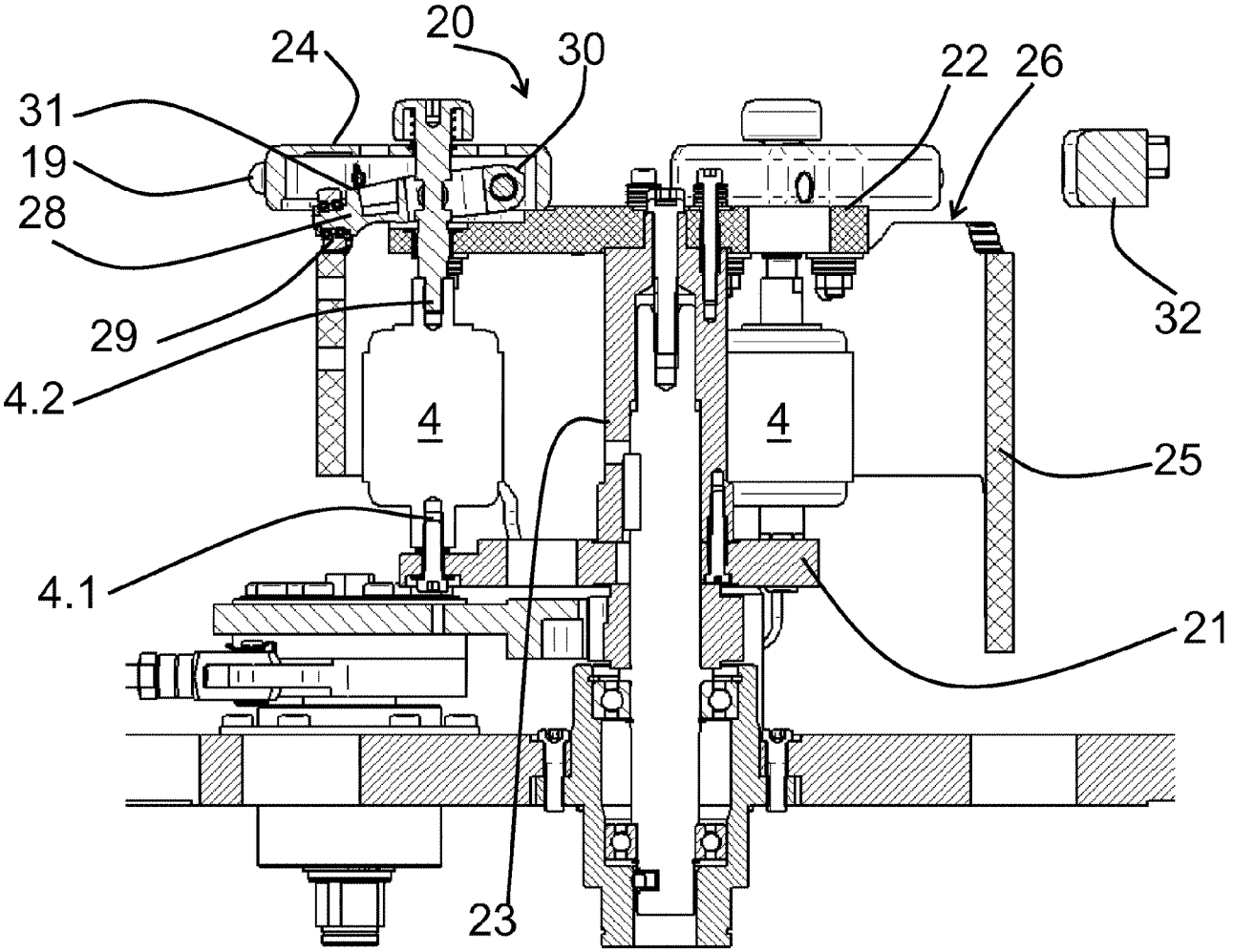
FIG. 5 is a section along the line A-A of FIG. 4.

In this embodiment the switch assembly 1 comprises a cam cylinder 25 shown in FIGS. 4 and 5. The polarity rotor 20 is arranged in the cam cylinder 25 to be oriented vertically. The cam cylinder 25 consists of an electrically insulating material, preferably a fibreglass composite material. The upper edge 26 of the cam cylinder 25 has a profiled contour 27 and is constructed as, in particular, an encircling profiled contour 27. The contour 27 serves for actuation of the vacuum interrupters 4. An actuating lever 28 with a roller 29 is provided for that purpose in each bearing housing 24. The actuating lever 28 is rotatably mounted at a first end 30 on the bearing housing 24 and carries, at a second end 31, the roller 29 that co-operates with the contour 27 when the polarity rotor 20 rotates. In that case, the respective actuating lever 28 and the respective movable contact 4.2 in operative connection therewith are moved in vertical direction and the respective vacuum interrupter 4 opened or closed.

The cam cylinder 25, polarity rotor 20, bearing housing 24 and actuating lever 28 thus form actuating means for actuating the vacuum interrupters 4 in predetermined sequence.

Figure 6:
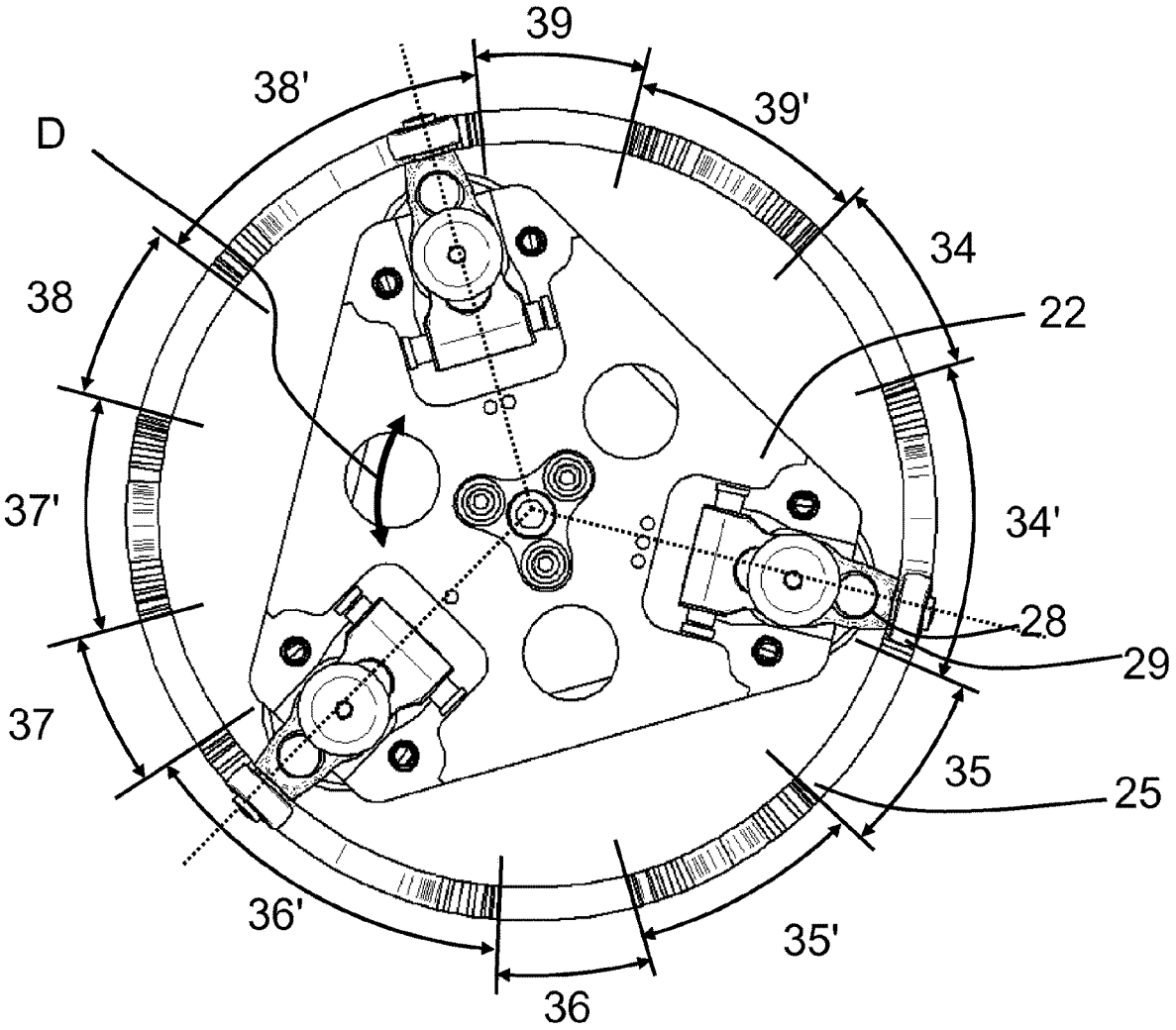
FIG. 6 is a plan view of FIG. 4 with removed bearing housings.

The switch assembly 1 is schematically illustrated in FIG. 6 from above, without the bearing housing 24, in a state corresponding with the end of the third step of 2*d*. The three vacuum interrupters 4 are arranged to be respectively offset by 120° relative to one another about the drive shaft 23. The contour 27 has six contour sections 34, 35, 36, 37, 38, 39, of which the first and second contour sections 34, 35 are associated with a first vacuum interrupter 4 the third and fourth contour sections 36, 37 are associated with a second vacuum interrupter 4 and the fifth and sixth contour sections 38, 39 are associated with a third vacuum interrupter 4. Each contour section 35 to 39 is formed as, for example, an elevation in the upper edge 26 and is bounded by two respective intermediate sections 34', 35', 36', 37', 38', 39' that are formed as, for example, a depression in the upper edge 26; however, it is also possible for each contour section 35 to 39 to be formed as a depression and each intermediate section 34' to 39' to be formed as an elevation in the upper edge 26. Since three vacuum interrupters 4 have to be actuated for opening, the three mutually corresponding contour sections 34, 36, 38 and the three mutually corresponding contour sections 35, 37, 39 are respectively offset by 120° relative to one another.

In the static state of the switch assembly 1 (FIGS. 2*a*, 2*h*, 4, 5) as well as in the state at the end of the third step (FIGS. 2*d*, 6) and in the state at the end of the fourth step (FIG. 2*e*) the vacuum interrupters 4 are closed. In order to be able to ensure this, the intermediate sections 34' to 39' are of such a shape and, in particular, of such a depth that the respective roller 29 at the actuating lever 28 no longer rests on the contour 27 and the upper edge 26. As a result it is ensured that each movable contact 4.2 reaches its deepest position and the respective vacuum interrupter 4 is closed. However, it is also possible for the intermediate sections 34' to 39' to be of such a shape and, in particular, of such a depth that the respective roller 29 at the actuating lever 28 rests on the contour 27 and the upper edge 26.

For example, the cam cylinder 25 is arranged to be stationary and the polarity rotor 20 is mounted to be rotatable, but the converse situation is also possible. Since the rollers 29 at least in the contour sections 35-39 rest on the upper edge 26, during rotation of the polarity rotor 20 they travel along the contour 20 or at least the contour sections 35-39 and accordingly open and close the respective vacuum interrupters 4 by means of the actuating levers 28.

In this embodiment the three mutually corresponding contour sections 34, 36, 38 have different lengths, wherein by example the first contour section 34 is longer than the fifth contour section 38 and this is longer than the third contour section 36. The other three mutually corresponding contour sections 35, 37, 39 also have different lengths, wherein, for example, the second contour section 35 is longer than the sixth contour section 39 and this is longer than the fourth contour section 37. It is thereby achieved that on rotation of the polarity rotor 20 the vacuum interrupters 4 are opened and closed with a small offset in time independently of the direction D of rotation of the rotor. The first contour section 34 is preferably longer than the fifth contour section 38, this is as long as the second contour section 35 and longer than the sixth contour section 39, this is longer than the fourth contour section 37 and this is as long as the third contour section 36. However, it is also possible for all contour sections 35-39 to be of the same length.

It is advantageous particularly for opening of the vacuum interrupters 4 if this takes place in succession, thus offset in time, so as to keep the torque needed for that purpose as low as possible.

Figure 7:
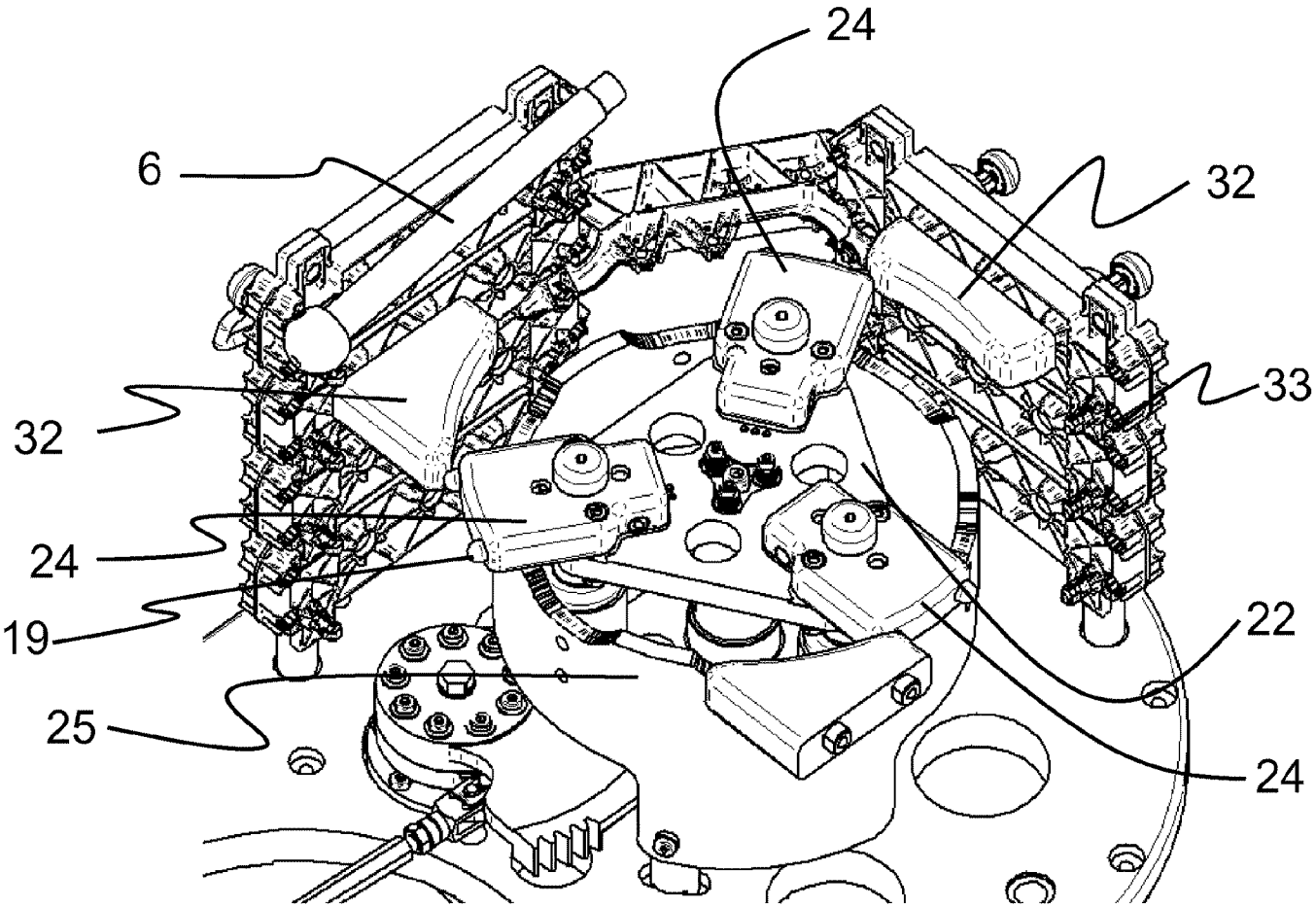
FIG. 7 is a perspective view of a preferred embodiment of the switch assembly of FIGS. 2*a-h* as a constructional configuration for three phases.

In this embodiment the switch assembly 1 has for each bearing housing 24 a switching-on contact 32 shown in FIG. 7. Each switching-on contact 32 is mounted in stationary position and preferably on a frame 33. The combination of a respective switching-on contact 32 and the respective bearing housing 24 forms the respective isolator 5 that is actuated, thus opened and closed, by rotation of the polarity rotor 20. Since each vacuum interrupter 4, the bearing housing 24 associated with this vacuum interrupter 4, the switching-on contact 32 associated with this vacuum interrupter 4, the drive shaft 23 and the lower support plate 21 are electrically conductively connected with one another it is possible through selectable production or separation of the connection between bearing housing 24 and switching-on contact 32, thus the selectable opening and closing of the isolator 5 and the selectable closing and opening of the vacuum interrupter 4, to selectably produce and separate an electrically conductive connection between the first connection terminal 1.1 and the second connection terminal 1.2, for example in accordance with the method described above with reference to FIGS. 2*a-h*.

The bearing housing 24 can have at its outer side resiliently mounted contacts 19 which enable secure contact-making between switching-on contact 32 and bearing housing 24.

Figure 8:
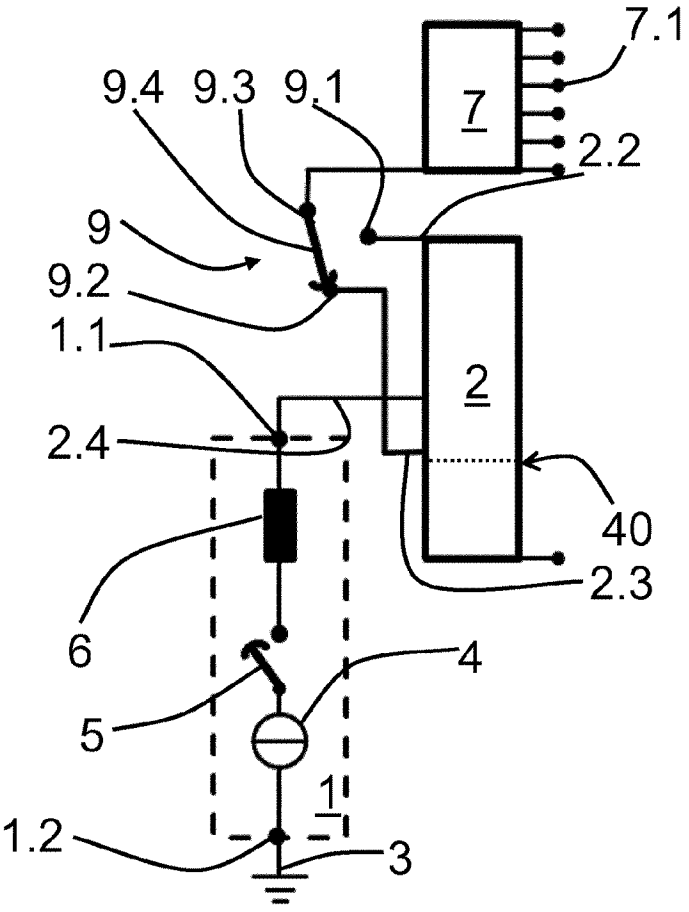
FIG. 8 is a circuit diagram of a second embodiment of the switch assembly.

A circuit diagram of a second embodiment of the switch assembly 1 for a control transformer 10 is schematically illustrated in FIG. 8. This embodiment is similar to the first embodiment, so that in the following primarily the differences are explained in more detail.

In this embodiment the first winding 2 is constructed as a coarse step winding that forms part of a main winding 40, the second winding 7 is constructed as a control winding associated with the coarse step winding 2, and the preselector 9 is constructed as a coarse selector for the coarse step winding 2. The control winding 7 has tapping points 7.1. The second winding tap 2.3 of the coarse tap winding 2 lies, for example, between the winding ends thereof. However, it is also possible, for example, for the first winding tap 2.2 of the coarse step winding 2 to lie between the winding ends thereof and the second winding tap 2.3 to lie at the second winding end thereof and/or to form this winding end or, for example, for both winding taps 2.2, 2.3 to lie between these winding ends.

The coarse winding 2 can, for example, be selectably connected or not connected with the control winding 7 by the preselector 9, thus be bridged over. The preselector 9 thus forms a coarse selector.

The invention claimed is:

1. A polarity switch for a control transformer comprising a first winding for a phase to be regulated, of an alternating current mains, the polarity switch comprising:

a first connection terminal connectable with the winding;

a second connection terminal connectable with a diverter;

a vacuum interrupter having a fixed contact and a movable contact;

an isolator having a stationary switching-on contact and an electrically conductive movable bearing housing selectably engageable with and disengageable from the switching-on contact;

a resistor connected in a series circuit with the vacuum interrupter and the isolator, the first connection terminal being connected with the second connection terminal by the series circuit;

a rotatable polarity rotor carrying the bearing housing and rotatable to actuate the isolator and the vacuum interrupter, the polarity rotor having a lower support plate carrying the fixed contact and an upper support plate mechanically connected to the movable contact, the vacuum interrupter being mounted vertically between the plates; and a vertical drive shaft between the support plates for rotating the polarity rotor.

2. The polarity switch defined in claim 1, further comprising:

an actuating lever mechanically connected to the movable contact, having a first end at which it is pivoted, and a second end; and a roller on the second end.

3. The polarity switch defined in claim 1, further comprising:

a cam cylinder in which the polarity rotor is rotatable; wherein the cam cylinder has at an upper edge a contour with at least one contour section; and the roller during rotation of the polarity rotor travels along the contour section for actuating the vacuum interrupter.

4. The polarity switch defined in claim 1, further comprising a respective additional first winding:

for each additional first winding an additional first connection terminal connectable with the additional winding, an additional second connection terminal connectable with a diverter, an additional vacuum interrupter, an additional isolator and an additional resistor connected in series with the additional vacuum interrupter and the additional isolator; and actuating means for actuating the vacuum interrupters in a predetermined sequence each additional first connection terminal being connected with the respective second connection terminal by the respective series circuit.

5. The polarity switch defined in claim 4, wherein the actuating means is so constructed that at least two vacuum interrupters are actuated with an offset in time relative to one another.

6. The polarity switch defined in claim 5, wherein the actuating means comprises the cam cylinder; and at least one contour section is assigned to each vacuum interrupter.

7. The polarity switch defined in claim 6, wherein the cam sections are so constructed that when the polarity rotor is rotated at least two vacuum interrupters are actuated with an offset in time relative to one another.

8. The polarity switch defined in claim 1, further comprising:

a second winding for at least one phase to be regulated, the first winding associated with this phase having a first winding tap and second winding tap and an intermediate tap between the winding taps; and a preselector comprising a first preselector terminal connectable with the first winding tap;

a second preselector terminal connectable with the second winding tap;

a base terminal connectable with the second winding; and a preselector contact connected with the base terminal and selectably connectable with the first or second preselector terminal, the first connection terminal being connectable with the first winding by connection with the intermediate tap.

9. The polarity switch defined in claim 8, wherein the preselector is constructed as a reverser or coarse selector.

* * * * *